United States Patent [19]

Postic

[11] Patent Number: 4,850,282

[45] Date of Patent: Jul. 25, 1989

[54] PORTABLE FOOD TRAY

[76] Inventor: Stephen Postic, 1496 Pembroke St., Bridgeport, Conn. 06608

[21] Appl. No.: 220,788

[22] Filed: Jul. 18, 1988

[51] Int. Cl.[4] ..... A47B 5/00

[52] U.S. Cl. ..... 108/47; 108/44

[58] Field of Search ..... 108/47, 90, 152, 44; 297/174; 211/90, 88, 87

[56] References Cited

U.S. PATENT DOCUMENTS

| | | | |
|---|---|---|---|
| 1,641,358 | 9/1977 | Smyser | 211/88 |
| 1,843,391 | 2/1932 | Gayle | 108/47 X |
| 2,474,943 | 7/1949 | Hedger | 108/135 X |
| 2,633,998 | 4/1953 | Derman | 108/44 X |
| 2,687,336 | 8/1954 | Smith et al. | 108/44 X |
| 2,932,544 | 4/1960 | Lambert | 108/47 X |
| 3,037,639 | 6/1962 | Kost | 108/47 X |
| 4,343,405 | 8/1982 | Virte et al. | 211/88 |
| 4,357,881 | 11/1982 | De Long | 108/47 X |
| 4,499,750 | 5/1984 | Pultman | 108/44 X |

*Primary Examiner*—Kenneth J. Dorner
*Assistant Examiner*—José V. Chen
*Attorney, Agent, or Firm*—John R. Doherty

[57] ABSTRACT

A portable tray comprising a tray surface supported by two spaced apart, vertical frames each including an upper and a lower, elongated, horizontal section, the upper section having at a rearward end an outwardly extending hanger which fits over the railing of a balcony, a horizontal leveling and stabilizing brace extending between the two frames, the brace having two leg sections which telescope with the rearward ends of the lower horizontal sections of the two frames, and structure for adjusting the length of the telescoping leg sections so that the brace rests against a row of pilaster boards extending downwardly from the railing, thereby supporting the tray surface in a substantially horizontal plane.

11 Claims, 4 Drawing Sheets

FIG. 5
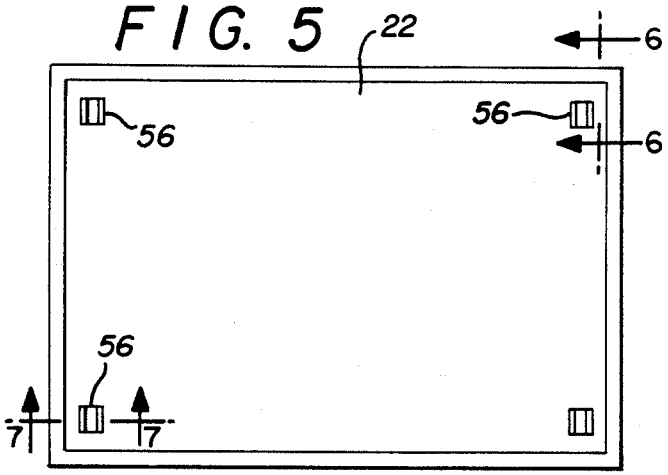
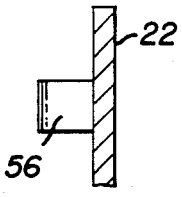
FIG. 6
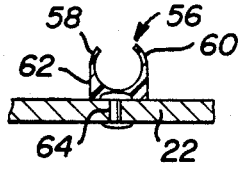
FIG. 7
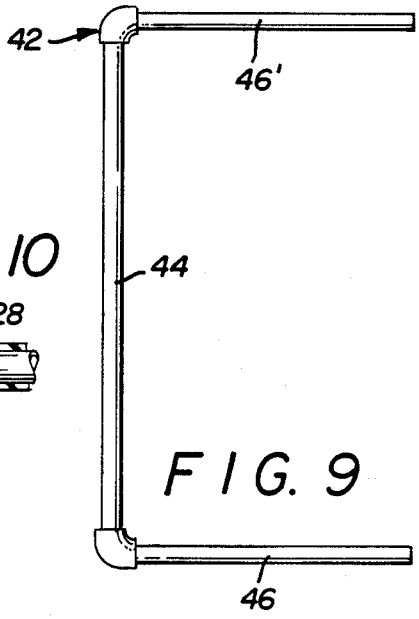
FIG. 9
FIG. 10
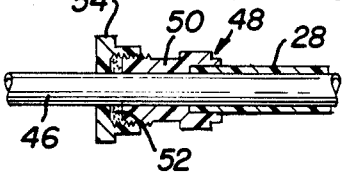
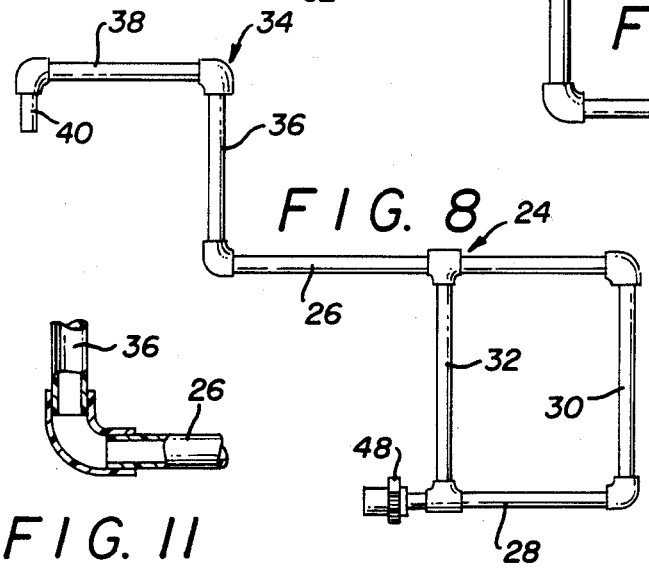
FIG. 8
FIG. 11

PORTABLE FOOD TRAY

FIELD OF THE INVENTION

My invention is directed to a portable food tray and especially a portable food tray which can be quickly and easily attached to a balcony.

BACKGROUND OF THE INVENTION

The portable food tray of the inv;ention differs from known trays in that it is designed to be supported horizontally rather than vertically and is characterized by increased stability and convenience in use. The present tray lacks the usual vertical legs for supporting the tray on a level floor. These vertical legs frequently pose a problem when the tray is used on an outdoor deck in that the bottom ends of the legs fall into the spaces between adjacent floor boards and render the tray uneven and/or unstable during use.

In the prior art, various portable trays for similar purposes are known.

U.S. Pat. No. 4,570,803 to Peterson discloses an accessory or tray which is suspended from a balcony by a pair of brackets.

U.S. Pat. No. 4,452,151 to Jarrard discloses a folding table for the trunk lid of an automobile having adjustable telescoping vertical legs.

U.S. Pat. No. 4,357,881 to De Long discloses a tray which is removably attached to the side rails of a hospital bed. The tray includes an adjustable telescoping brace to accomodate rails of different rung spacing.

U.S. Pat. No. 4,337,751 to Sampson et al discloses a similar tray for an outdoor barbecue grill.

U.S. Pat. No. 4,089,276 to Enos discloses a portable platform having brackets for attachment to the bumper of an automobile.

SUMMARY OF THE INVENTION

The present invention is a portable food tray for attachment to a balcony. The tray comprises a substantially flat tray surface and two spaced apart, vertical frames for supporting the tray surface. The vertical frames include upper and lower, elongated, horizontal sections each having a forward and a rearward end. The tray surface is provided with clip means for removably attaching the tray surface to the upper elongated, horizontal sections of the two frames. The upper, elongated, horizontal sections of the frames are formed at the rearward ends with outwardly extending hangers which are shaped to fit over the railing on top of the balcony. A horizontal, leveling and stabilizing brace extends laterally between the two frames, the brace having two spaced apart leg sections which telescope with the rearward ends of the lower horizontal sections of the frames. Means are provided for adjusting the length of the telescoping leg sections so that the horizontal stabilizing brace rests against the row of pilaster boards which extend downwardly from the railing, thereby supporting the tray surface in a substantially horizontal plane.

DESCRIPTION OF THE DRAWINGS

In the accompanying drawings:

FIG. 5 is a plan view showing the underneath side of a rectangular tray surface employed in the tray of FIG. 1;

FIG. 6 is an enlarged side elevational view taken along the lines 6—6 in FIG. 5 showing a flexible clip used to removably attach the tray surface to the elongated, tubular frames supporting the tray;

FIG. 7 is an enlarged sectional view taken along the lines 7—7 in FIG. 5 showing the flexible clip in greater detail;

FIG. 8 is a side elevational view of the tray supporting frame as it appears with the tray completely disassembled;

FIG. 9 is a similar view of the horizontal, leveling and stabilizing brace used in the tray of FIG. 1;

FIG. 10 is a sectional view of a tubular compression nut employed to adjust the length of the telescoping leg sections of the horizontal brace; and FIG. 11 is a sectional view of a typical elbow joint used in each frame.

DETAILED DESCRIPTION OF THE INVENTION

Figure 1:
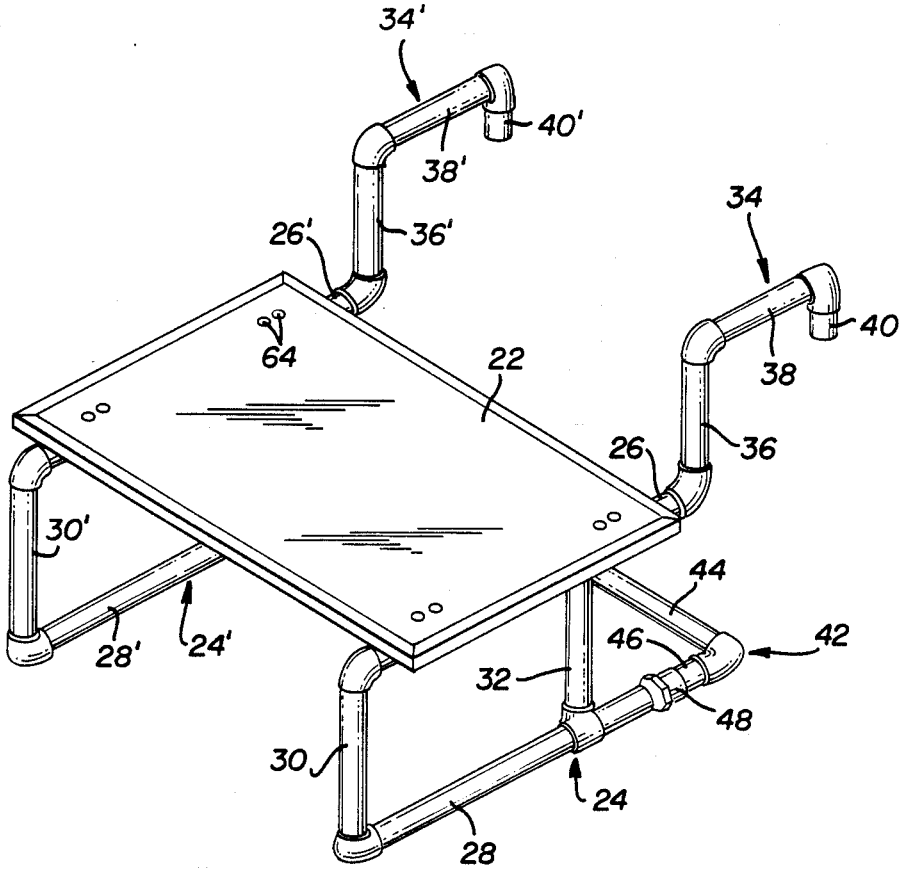
FIG. 1 is a perspective view of a portable food tray according to the invention.
Figure 2:
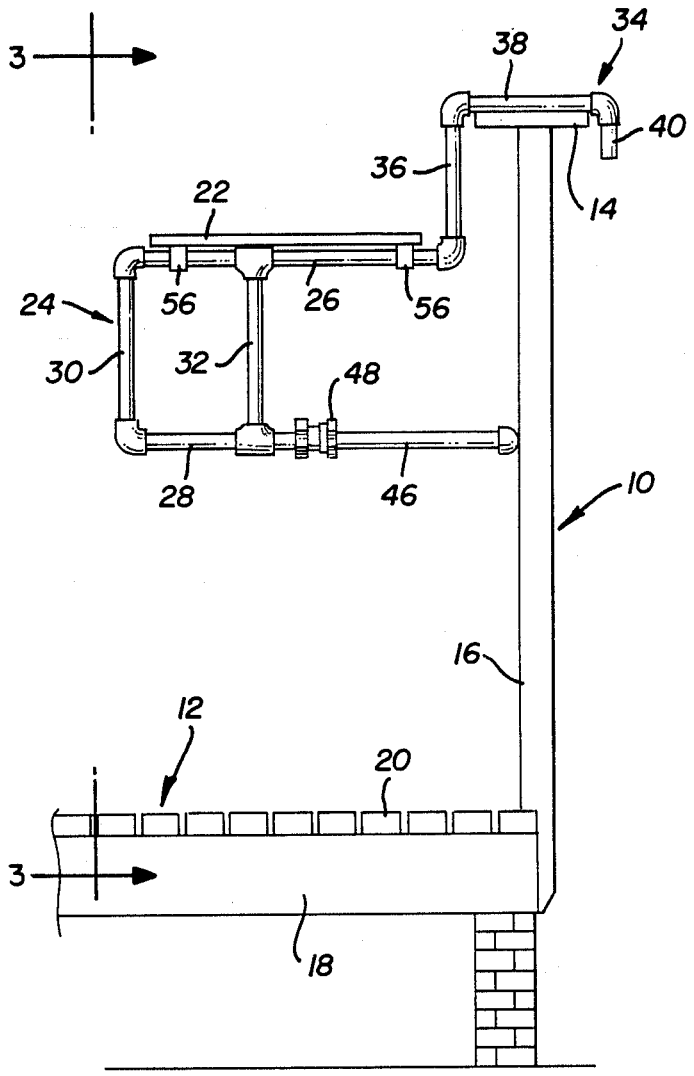
FIG. 2 is a side elevational view showing the portable food tray attached to a balcony enclosing an outdoor deck.

Referring now to the drawing, a portable food tray according to the invention attaches to a balcony 10 enclosing an outdoor deck 12. The balcony 10 has a horizontal top railing 14 and a row of flat, vertical, spaced apart, pilaster boards 16 which extend downwardly from the railing 14. Typically, the row of pilaster boards 16 are secured at their lower ends to a header plate (not shown) holding the floor joists 18. The deck boards 20 are secured to the floor joists 18 in spaced apart relation as depicted in FIG. 2.

The present tray is designed particularly for attachment to a balcony employing a railing 14 which is wider than the pilaster boards 16, thus providing a large overhang at the top of the balcony. A balcony with this type of railing does not easily accommodate the usual brackets and hangers that are commonly employed in the known portable trays and that, for this reason, the known trays have not exhibited good stability and convenience in use.

In the preferred embodiment of the invention illustrated in the drawing, the portable food tray includes a flat, rigid, rectangular tray surface 22 which can be made of metal, plastic or wood, for example. The tray surface 22 is supported on opposite sides by two spaced apart, vertical, tubular frames generally indicated at 24 and 24'. These frames are ideally made of plastic tubing joined together with plastic tee and elbow connections (FIG. 11) which are commonly found in the plumbing industry. Conventional ½ inch I.D. PVC pipe, tee connections and elbow fittings are recommended for use in constructing the tray.

The frames 24, 24' are identical to one another, each being made of an upper, elongated, horizontal tube 26, 26' and a lower, elongated, horizontal tube 28, 28'. These upper and lower horizontal tubes are connected at the forward end of the tray by an elongated, vertical tube 30, 30'. A second elongated, vertical tube 32, 32' connecting the upper and lower tubes at or close to the rearward end of the tray may also be employed for added support and strength.

The upper, elongated, horizontal tube 26, 26' of each frame has formed at its rearward end an outwardly extending, inverted U shaped hanger 34, 34'. The hangers may be made of a vertical tube 36, 36' connected by an elbow (FIG. 11) to the rearward end of the upper tube 26, 26', a horizontal tube 38, 38' connected at one end to the vertical tube 36, 36' and a second but shorter vertical tube 40, 40' connected to the opposite end of the horizontal tube 38, 38'. The horizontal tube 38, 38' of each frame is made to a length, say about 8 inches, which will enable the hanger to fit around the top railing 14 of most outdoor balconies as shown, for example, in FIGS. 2–4.

An adjustable, horizontal, leveling and stabilizing brace is provided for the tray as generally indicates at 42. The brace is substantially U shaped in configuration (see FIG. 9) including an elongated, horizontal support tube 44 extending laterally between the two frames 24 and 24' and two horizontal, spaced apart, tubular leg sections 46, 46'. The two leg sections 46, 46' are each connected to an end of the horizontal support tube 44 by an elbow and extend forwardly into telescoping engagement with the rearward end of each lower, elongated, horizotal tube 28, 28' of each frame. The length of the horizontal support tube 44 determines the spacing between the two frames 24, 24' and is always s less than the width of the tray surface 22.

A tubular compression nut 48, 48' is affixed to the rearward end of each lower, elongated, horizontal tube 28, 28' for adjusting the length of the telescoping leg sections 46, 46'. The compression nut 48 is of conventional design including a tubular bushing 50 having at one end a resilient gasket 52 and a threaded cylindrical cap 54. When the cap 54 is threaded onto the bushing 50, the gasket 52 is compressed tightly around the leg section 46 and secures it in place at the rearward end of each frame.

FIGS. 6 and 7 show in enlarged detail one of four flexible clips 56 that are used for removably attaching the tray surface 22 to each of the frame 24, 24'. Each clip 56 comprises two spaced, resilient, semi-cylindrical fingers 58 and 60 joined to a base 62 which is affixed by rivets 64 to the underneath side of the tray surface 22. The clips 56 are located close to the four corners of the tray surface 22 and are arranged so that two clips align with one another on opposite sides of the tray surface.

The portable tray of the invention can be shipped or stored away in four separate pieces, namely, the tray surface 22, the two frames 24, 24' and the leveling and stabilizing brace 42. This feature also makes it possible to package the tray in relatively small boxes for both shipment and storage.

The tray can be quickly assembled by pressing two aligned flexible clips 56 on the underneath side of the tray surface 22 over the upper, horizontal tubes 26, 26' in order to attach the tray surface to each frame. The brace 40 is then assembled by inserting the two leg sections 46, 46' into the rearward end of each lower, horizontal tube 28, 28'. The tray is then ready for attachment to a balcony.

Figure 3:
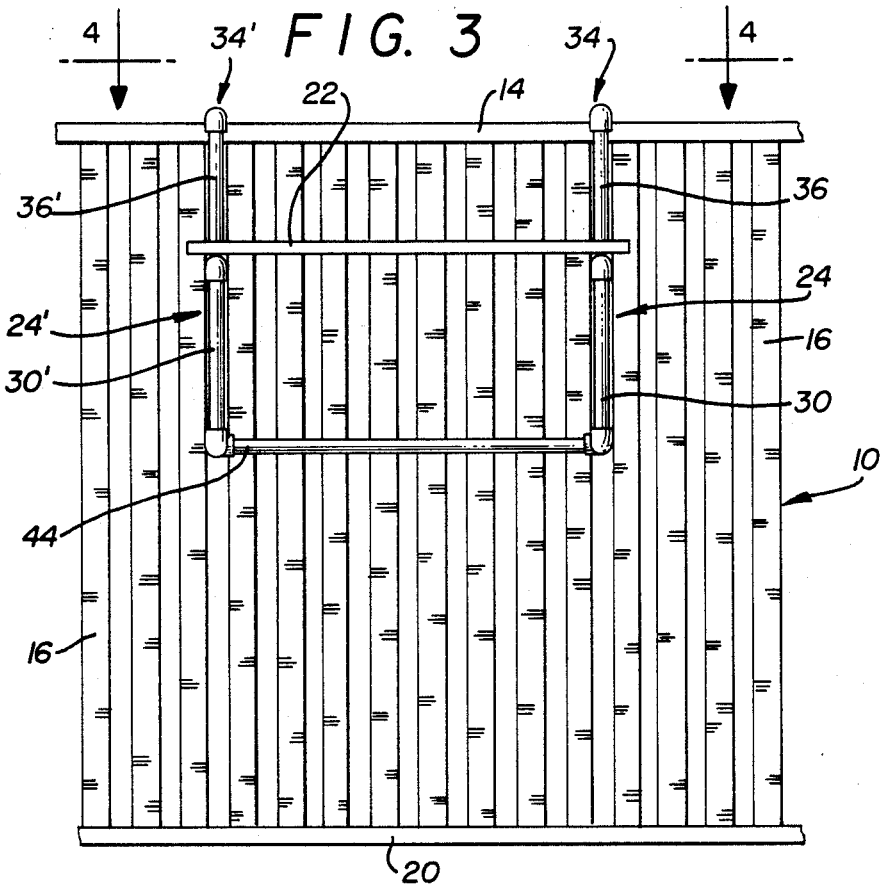
FIG. 3 is a view taken along the lines 3—3 in FIG. 2 showing the front of the tray.
Figure 4:
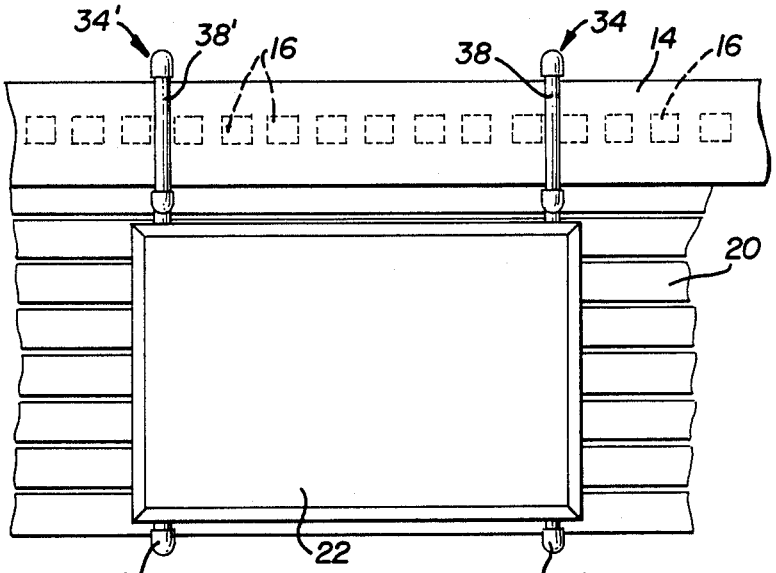
FIG. 4 is a view taken along the lines 4—4 in FIG. 3 showing the top of the tray.

Attachment to the balcony is easily and quickly accomplished by simply placing the hangers 34, 34' from each frame over the railing 14 allowing the elongated, horizontal support tube 44 to rest against the row of vertical pilaster boards 16 as shown in FIGS. 2–4. The brace 42 is then adjusted by moving the two leg sections 46, 46' in either a forward or rearward direction to level and stabilize the tray surface 22 in a substantially horizontal plane. Finally, the two compression nuts 48, 48' are tightened to secure the legs and the brace in place.

To disassemble the tray for storage after use, it is only necessary to remove the tray surface 22 by unclipping it from the two vertical frames 24 and 24' and then folding or collapsing the two frames inwardly one on top of the other between the two leg sections 46, 46'. The tray can then be stored away with the tray surface 22 placed on top of the collapsed frames.

This feature is advantageous in that it permits the tray to be disassembled for storage without disturbing the pre-set lenghts of the two leg sections 46, 46'. Thus, the tray can be quickly attached again to the same balcony without further adjustment of the leg sections.

What is claimed is:

1. A portable food tray for attachment to a balcony including a railing, said tray comprising, in combination:

(a) a substantially flat tray surface;

(b) two spaced apart, substantially vertical frames supporting said tray surface, each of said frames including upper and lower elongated, substantially horizontal sections having forward and rearward ends, said upper horizontal section of each frame forming at its rearward end an outwardly extending hanger which is shaped to fit over said railing, (c) means for removeably attaching said tray surface to said upper, elongated, horizontal section of each frame;

(d) a subtantially horizontal, leveling and stabilizing brace extending laterally between said frames, said brace having two spaced apart leg sections which telescope with the rearward ends of said lower horizontal sections of said frames; and (e) means for adjusting the length of said telescoping leg sections.

2. A portable food tray according to claim 1, wherein said tray surface is substantially rectangular in shape.

3. A portable food tray according to claim 2, wherein said two spaced apart, vertical frames are tubular.

4. A portable food tray for attachment to a balcony including a railing, said tray comprising, in combination:

(a) a substantially flat, rectangular tray surface;

(b) two spaced apart, substantially vertical frames supporting said tray surface, each of said frames including upper and lower elongated, substantially horizontal tubes joined together by at least one elongated, substantially vertical tube and having forward and rearward ends, said upper horizontal tube of each frame having formed at its rearward end an outwardly extending hanger which is shaped to fit over said railing, (c) means for removeably attaching said tray surface to said upper, elongated, horizontal tube of each frame;

(d) a substantially horizontal, leveling and stabilizing brace extending laterally between said frames, said brace having two spaced apart leg sections which telescope with the rearward ends of said lower horizontal tubes; and (e) means for adjusting the length of said telescoping leg sections.

5. A portable food tray according to claim 4, wherein said hanger is composed of a substantially horizontal tube joined at each end by two substantially vertical tubes forming an inverted U shape.

6. A portable food tray according to claim 5, wherein said means for removably attaching said tray surface comprises flexable clips mounted to the underneath side of said tray surface.

7. A portable food tray according to claim 6, wherein said leveling and stabilizing brace is tubular.

8. A portable food tray according to claim 7, wherein said brace is substantially U shaped including an elongated, substantially horizontal, support tube having two ends and two spaced apart, tubular legs one of each of which is joined to one of said ends of said support tube.

9. A portable food tray according to claim 8, wherein said means for adjusting the length of said telescoping leg sections comprises a tubular compression nut assembly.

10. A portable food tray according to claim 9, wherein said compression nut assembly includes a tubular bushing having at one end a resilient gasket and a cylindrical cap threaded onto said bushing and tightening said gasket around said leg section.

11. In combination; a balcony having a railing and a row of pilaster boards extending downwardly from said railing and a portable food tray, said tray comprising, in combination:

(a) a substantially flat, rectangular tray surface;

(b) two spaced apart, substantially vertical frames supporting said tray surface, each of said frames including upper and lower elongated, substantially horizontal tubes joined together by at least one elongated, substantially vertical tube and having forward and rearward ends, said upper horizontal tube of each frame having formed at its rearward end an outwardly extending hanger which is shaped to fit over said railing, (c) means for removeably attaching said tray surface to said upper, elongated, horizontal tube of each frame;

(d) a substantially horizontal, leveling and stabilizing brace extending laterally between said frames, said brace having two spaced apart leg sections which telescope with the rearward ends of said lower horizontal tubes; and (e) means for adjusting the length of said telescoping leg sections so that said horizontal brace rests against said row of pilaster boards when the hangers on said frames are fitted over said railing thereby supporting said tray surface in a substantially horizontal plane.

* * * * *